US005887447A

United States Patent [19]

Higginbotham

[11] Patent Number: 5,887,447

[45] Date of Patent: Mar. 30, 1999

[54] AIR SEPARATION IN A DOUBLE RECTIFICATION COLUMN

[75] Inventor: Paul Higginbotham, Guildford, England

[73] Assignee: The BOC Group plc, Windlesham Surrey, England

[21] Appl. No.: 86,632

[22] Filed: May 29, 1998

[30] Foreign Application Priority Data

May 30, 1997 [GB] United Kingdom ..... 9711258

[51] Int. Cl.[6] ..... F25J 3/04

[52] U.S. Cl. ..... 62/643; 62/648; 62/646

[58] Field of Search ..... 62/643, 646, 648, 62/913

[56] References Cited

U.S. PATENT DOCUMENTS 3,173,778 3/1965 Gaumer, Jr. ..... 62/648
4,057,972 11/1977 Sarsten ..... 62/912 X
4,072,023 2/1978 Springmann ..... 62/650
5,412,953 5/1995 Darredeau et al. ..... 62/646
5,582,032 12/1996 Shelton et al. ..... 62/643
5,806,341 9/1998 Rathbone ..... 62/646

*Primary Examiner*—Christopher B. Kilner
*Attorney, Agent, or Firm*—David M. Rosenblum; Salvatore P. Pace

[57] ABSTRACT

Air is separated in a double rectification column comprising a higher pressure rectification column, a lower pressure rectification column and a condenser-reboiler placing the higher pressure rectification column in heat exchange relationship with the lower pressure rectification column. At least one stream of air is introduced into the double rectification column, a stream of pressurized liquid comprising oxygen and nitrogen is reduced in pressure by passage through a valve and is partially or totally vaporized in a vaporizer-condenser, a stream of resulting vapor from the partial or total vaporization is compressed in a compressor at cryogenic temperature and is introduced into the double rectification column, and an oxygen produce is withdrawn from the lower pressure rectification column through an outlet.

16 Claims, 1 Drawing Sheet

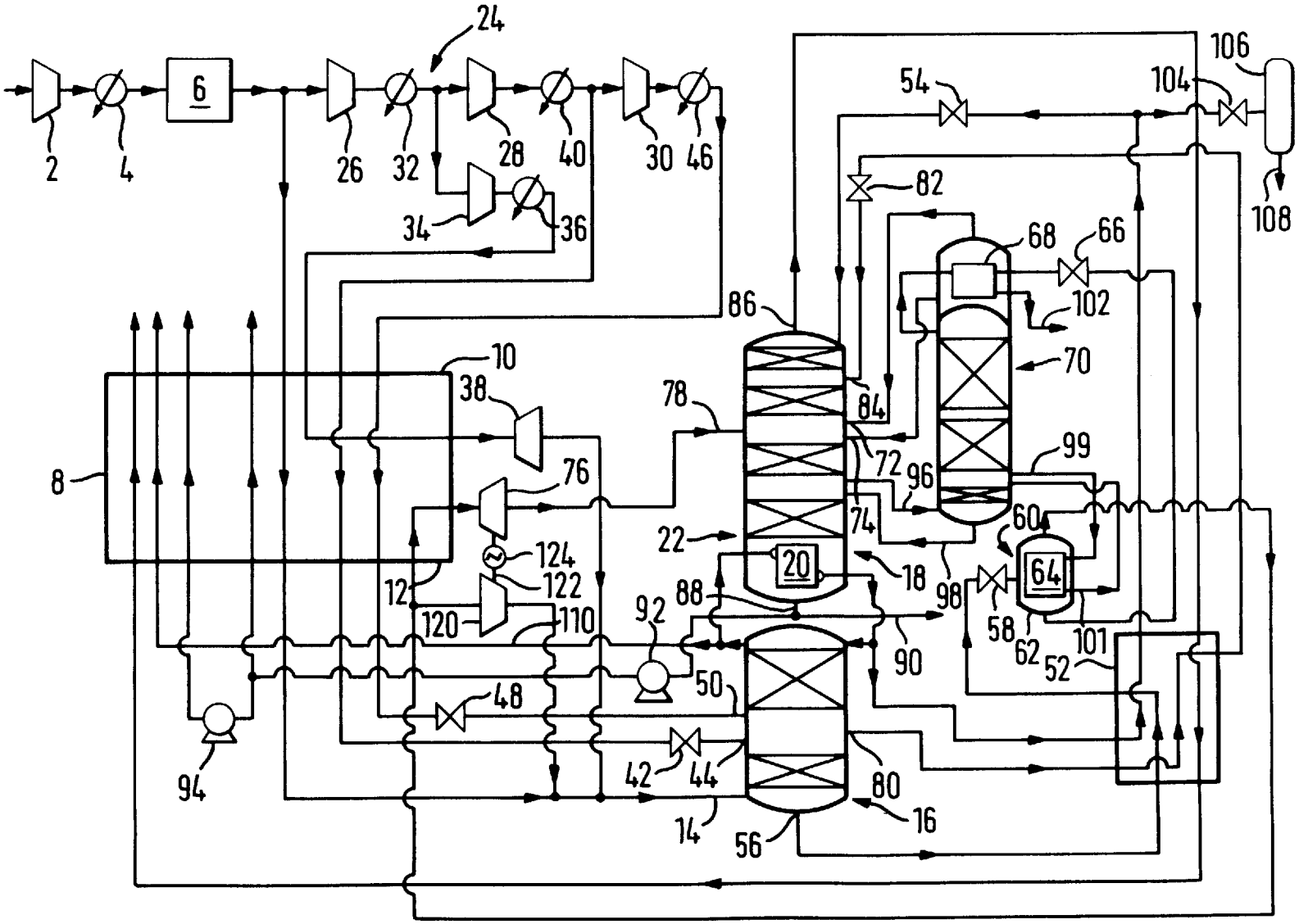
106
108
104
66
102
70
99
101
52
68
60
64
62
58
54
82
96
98
18
90
16
84
72
74
80
86
20
56
78
22
88
50
44
14
46
30
92
42
40
36
76
124
122
110
28
24
10
38
48
34
120
32
12
26
6
94
4
2
8

AIR SEPARATION IN A DOUBLE RECTIFICATION COLUMN

FIELD OF THE INVENTION

This invention relates to a method and apparatus for separating air.

BACKGROUND OF THE INVENTION

Air separation by rectification (at cryogenic temperatures) is well known. Typically, in such methods the air is separated in a double rectification column comprising a higher pressure rectification column, a lower pressure rectification column and a condenser-reboiler placing the higher pressure rectification column in heat exchange relationship with the lower pressure rectification column. Such an arrangement enables an oxygen product to be withdrawn from a bottom region of the lower pressure rectification column. In addition, a nitrogen product is typically taken from the top of the lower pressure rectification column.

Normally, a relatively high yield or recovery of oxygen from the incoming air can be achieved by rectification of the air in a double rectification column. However, various demands may be placed on the separation such that the oxygen recovery will fall. Such demands include the production of liquid products in an amount in excess of 5% of the total oxygen production when refrigeration of the process is provided by turboexpansion of air into the lower pressure rectification column; a requirement for a liquid nitrogen product; and a requirement for a gaseous nitrogen product not only from the lower pressure rectification column but also from the higher pressure rectification column. The demands on the separation process are increased if an argon product is formed by withdrawing an oxygen stream containing argon from the lower pressure rectification column and separating argon from it in a side rectification column. Further, if an argon product is produced, co-production of a nitrogen product from the higher pressure rectification column or co-production of relatively large proportions of liquid products can have a drastic effect on the argon recovery.

U.S. Pat. No. 5,469,710 relates to an air separation method employing a double rectification column and a side column in which an argon product is produced, wherein oxygen-enriched liquid is taken from the bottom of the higher pressure rectification column, is passed through a throttling valve into a condenser in which argon is condensed, the oxygen-enriched liquid thereby being vaporised, and a stream of the resulting vapour is expanded with the performance of external work and introduced into the lower pressure rectification column. Such an arrangement is advantageous in that it is a useful way of providing additional refrigeration for the separation, thereby adding to the flexibility of the method in being able to provide liquid products without unacceptable product recoveries or unacceptable power consumption. The method is, however, limited by the fact that the argon condenser needs to be operated at a pressure less than 2 bar in order to provide the necessary temperature difference for the condensation of argon; therefore the amount of refrigeration that can be produced by expansion to the pressure of the lower pressure rectification column is strictly limited.

It is an aim of the present invention to provide a method and apparatus which enables oxygen recovery, and, if separated, argon recovery to be enhanced.

SUMMARY OF THE INVENTION

According to the present invention there is provided a method of separating air in a double rectification column comprising a higher pressure rectification column, a lower pressure rectification column, and a condenser-reboiler placing the higher pressure rectification column in heat exchange relationship with the lower pressure rectification column, wherein at least one stream of air is introduced into the double rectification column, a stream of pressurised liquid comprising oxygen and nitrogen is reduced in pressure and is partially or totally vaporised, a stream of resulting vapour from the partial or total vaporisation is compressed at cryogenic temperature and is introduced into the double rectification column, and an oxygen product is withdrawn from the lower pressure rectification column.

The invention also provides apparatus for separating air, comprising a double rectification column comprising a higher pressure rectification column, a lower pressure rectification column, and a condenser-reboiler placing the higher pressure rectification column in indirect heat exchange relationship with the lower pressure rectification column; at least one inlet to the double rectification column for at least one stream of air to be separated; a vaporiser-condenser having vaporising passages in communication via pressure reduction means with a source of pressurised liquid comprising oxygen and nitrogen to be partially or totally vaporised; a cryogenic compressor having an inlet communicating with an outlet for vaporised pressurised liquid from the vaporiser-condenser, and an outlet communicating with the double rectification column; and an outlet from the lower pressure rectification column from an oxygen product.

The stream of pressurised liquid comprising oxygen and nitrogen is preferably provided at a pressure not less than the operating pressure of the higher pressure rectification column; more preferably it is provided at the operating pressure of the higher pressure rectification column and may be taken therefrom. The method and apparatus according to the invention allow more vapour to be processed in the higher pressure rectification column, providing more liquid nitrogen reflux for the lower pressure rectification column and increasing the oxygen recovery, and if it is to be separated, the argon recovery, while allowing a relatively large quantity of nitrogen to be taken as product from the higher pressure rectification column in vapour or liquid state. These advantages are obtained in comparison with an arrangement in which the pressurised stream of liquid is introduced into the higher pressure rectification column or not taken therefrom in the first place. The method and apparatus according to the invention also avoid the thermodynamic loss of work associated with re-heating to ambient temperature and re-cooling to a cryogenic temperature a stream of fluid taken from one of the rectification columns, such re-heating and re-cooling being a feature of conventional recycle processes.

Preferably, another stream of the said resulting vapour is expanded in a turbine and is introduced into the lower pressure rectification column. Thus, the expansion turbine has an inlet communicating with an outlet for vaporised pressurised liquid from the vaporiser-condenser, and an outlet communicating with the lower pressure rectification column. By employing such a preferred arrangement, the advantages described above can be achieved, if desired, without any additional refrigeration requirements and hence without any additional power consumption. For example, the cryogenic compressor and expansion turbine may be mounted on the same shaft and arranged so that the refrigeration produced by the expansion can exactly balance the work input via the compressor. Alternatively, the compressor and expansion turbine may have separate shafts, or the expansion turbine can be additionally coupled to a heat dissipative device such as a brake, or to a motor or to a generator of electrical power. If more power were generated by the expansion turbine than consumed by the compressor, there would be a net cold production, allowing more liquid to be produced or more high pressure gaseous nitrogen product to be formed, or the overall power consumption could be reduced. If the cryogenic compressor were to consume more power and generated by the expansion turbine, more reflux would be produced for the lower pressure rectification column by processing more vapour in the high pressure column but at the cost of a greater demand for refrigeration to offset the extra power input into the cryogenic compressor, so the overall power consumption would increase.

It can thus be appreciated that these preferred examples of the method and apparatus according to the invention are particularly flexible, especially when a stream of argon-containing oxygen is taken from the lower pressure rectification column and separated in the side rectification column and enables, electrical power, argon and nitrogen to be traded on demand.

The method and apparatus according to the present invention may employ a conventional double rectification column, that is to say the condenser-reboiler reboils a bottom liquid fraction separated in the lower pressure rectification column, the reboiling being effected by indirect heat exchange with a nitrogen vapour fraction that is separated in the higher pressure rectification column. In such examples, the vapour stream compressed at cryogenic temperature is preferably introduced into the higher pressure rectification column. In these examples, the partial or total vaporisation of the stream of pressurised liquid is preferably performed at a pressure in excess of about 2 bar in a vaporiser-condenser separate from any condenser in which argon-rich vapour containing at least about 90 mole percent of argon is condensed.

The stream of pressurised liquid preferably comprises an oxygen-enriched liquid withdrawn from a bottom region of the higher pressure rectification column. Typically, if the pressure at the bottom of the lower pressure rectification column is in the order of 1.4 bar, the pressurised liquid can be partially vaporised at a pressure of about 2.6 bar. A higher vaporisation pressure can be achieved if the stream of pressurised liquid comprises a stream of liquid withdrawn from an intermediate mass exchange region of the higher pressure rectification column, typically containing from about 20 to about 22 mole percent of oxygen, or if the stream of pressurised liquid comprises a stream of air which is liquefied or condensed in indirect heat exchange with one or more liquid streams taken from the double rectification column. It is also possible to use a pressurised liquid which comprises a mixture of liquids from two or more of the sources, for example, a mixture of an oxygen-enriched liquid stream withdrawn from a bottom region of the higher pressure rectification column and a stream of liquid withdrawn from an intermediate mass exchange region of the higher pressure rectification column.

The method and apparatus according to the present invention are also of use if the double rectification column is of a plural reboiler kind. In such an arrangement the said condenser-reboiler reboils an intermediate fraction separated in the lower pressure rectification column by indirect heat exchange with a stream of nitrogen separated in the higher pressure rectification column. An additional condenser-reboiler reboils a bottom liquid fraction by indirect heat exchange with a stream of vaporous air, the stream of vaporous air thereby being partially or totally condensed. If desired, a stream of condensate may be taken as the said stream of pressurised liquid. If the double rectification column is of a plural reboiler kind, the partial or total vaporisation of the stream of pressurised liquid may be performed at a pressure less than that needed if a conventional double rectification column is used, and typically at a pressure less than about 2 bar. If a double rectification column of a plural reboiler kind is used, the cryogenically compressed vapour stream may be produced at a pressure at which it can be passed through one of the reboilers, if desired, in a mixture with air, upstream of being introduced into the double rectification column, typically into the higher pressure rectification column.

If the method and apparatus according to the present invention do not include additional separation of an argon product, the partial or total vaporisation is preferably effected by indirect heat exchange with a stream of nitrogen separated in the higher pressure rectification column, the stream of nitrogen thereby being condensed. The resulting liquid nitrogen may be taken as product or may be used as reflux in the double rectification column in order to compensate for liquid nitrogen product taken therefrom or gaseous nitrogen product taken from the higher pressure rectification column.

The method and apparatus according to the present invention are also of use if the double rectification column is of a plural reboiler kind. In such an arrangement the said condenser-reboiler reboils an intermediate fraction separated in the lower pressure rectification column by indirect heat exchange with a stream of nitrogen separated in the higher pressure rectification column.

An additional condenser-reboiler reboils a bottom liquid fraction by indirect heat exchange with a stream of vaporous air, the stream of vaporous air thereby being partially or totally condensed. If desired, a stream of condensate may be taken as the said stream of pressurised liquid. If the double rectification column is of a plural reboiler kind, the partial or total vaporisation of the stream of pressurised liquid may be performed at a pressure of less than about 2 bar.

The method and apparatus according to the present invention are nonetheless particularly suitable for use if an argon product is to be separated, for example, by withdrawing from an intermediate mass exchange region of the lower pressure column a vaporous oxygen stream containing argon typically in an amount in the range of about 5 to about 15% by volume, and separating it in a side rectification column. In such examples of the method and apparatus according to the invention the partial or total vaporisation may be effected by indirect heat exchange with a stream of nitrogen taken from the higher pressure rectification column. Preferably, however, the partial or total vaporisation is effected by indirect heat exchange of the stream pressurised liquid with one or more of the following streams:

a) a stream of vapour withdrawn from the same region of the lower pressure rectification column as that from which the argon-containing oxygen vapour stream is withdrawn for separation in the side column;

b) a stream of oxygen-enriched vapour withdrawn from a region of the lower pressure rectification column above the region from which the argon-containing oxygen vapour stream is withdrawn for separation in the side column but below that at which oxygen-enriched vapour is introduced into the lower pressure rectification column for separation; and c) a stream of vapour withdrawn from the side rectification column, particularly from an intermediate mass exchange region thereof.

In each of the examples a) to c) above, the vapour stream which is heat exchanged with the vaporising pressurised liquid mixture is typically condensed thereby. A stream of the resulting condensate is preferably returned to the region from which the vapour is taken upstream of its condensation. Preferably, if the stream of pressurised liquid is partially vaporised, a stream of residual pressurised liquid is reduced in pressure by passage through a valve, is vaporised, preferably in indirect heat exchange with condensing argon separated in the side rectification column, and the resulting vapour is introduced into a chosen region of the lower pressure rectification column above that from which the argon-containing oxygen vapour stream is taken for separation in the side rectification column. Since the partial vaporisation has the effect of enriching the residual liquid in oxygen, the vaporised residual liquid stream that is introduced into the lower pressure rectification column has a higher oxygen mole fraction than in comparable conventional processes. As a result, a "pinch" at the region where the vaporised residual liquid stream is introduced into the lower pressure rectification column can be arranged to be at a higher oxygen concentration than the equivalent point in a comparable conventional process. Accordingly, the liquid-vapour ratio in the section of a lower pressure rectification column extending immediately above the region from which the argon-oxygen containing oxygen vapour stream is taken for separation in the side rectification column can be made greater than in the conventional process. Therefore, the feed rate to the side rectification column can be increased. It is thus possible to reduce the concentration of argon in the vapour feed to the side rectification column (in comparison with a comparable conventional process) without sacrificing argon recovery. A consequence of this is that the lower pressure rectification column needs less reboil to achieve a given argon recovery. Thus, for example, the rate of production or the purity of a liquid product from the lower pressure rectification column or the rate of production of a gaseous nitrogen product from the higher pressure rectification column may be enhanced.

Any conventional refrigeration system may be employed in addition to the said expansion turbine may be employed to meet the refrigeration requirements of a method and apparatus according to the invention. These requirements will vary, for example, according to the ratio of the sum of the rates of production of liquid products to the total rate of production of oxygen product. If this ratio is above, say, about 0.15 to 1, the refrigeration system preferably includes a turbine which has an inlet communicating with the source of air to be separated and an outlet which communicates with the higher pressure rectification column. If a pressurised, gaseous oxygen product is formed by vaporising and warming a pressurised liquid oxygen stream in indirect heat exchange relationship with one or more return streams from the double rectification column, there will also be a need to produce an air stream at an appropriately high pressure.

Typically, there is a vaporous air feed to the higher pressure rectification column which is preferably taken from a source of compressed air which has been purified by extraction therefrom of water vapour, carbon dioxide, and, if desired, hydrocarbons, and which has been cooled in indirect heat exchange with products of the air separation. There is also typically a liquefied air feed to one or both of the higher pressure and lower pressure rectification columns which is preferably formed in an analogous manner.

Each rectification column may comprise a distillation or fractionation zone or zones, wherein liquid and vapour phases are countercurrently contacted to effect separation of the fluid mixture, as for example, by contacting the vapour and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel might typically have a height of over 50 meters. It is therefore desirable to construct the argon rectification column in two separate vessels so as to avoid having to employ a single, exceptionally tall, vessel.

BRIEF DESCRIPTION OF THE DRAWING

The method and apparatus according to the invention will now be described by way of example with reference to the accompanying drawing which is a schematic flow diagram illustrating an air separation plant.

The drawing is not to scale.

DETAILED DESCRIPTION OF THE INVENTION

Referring to the drawing, a flow of air is compressed in a main air compressor 2 and has heat of compression removed therefrom in an aftercooler 4. The resulting aftercooled, compressed, air stream is purified in unit 6 by removal of water vapour, carbon dioxide and typically hydrocarbons therefrom. Unit 6 may effect this purification by temperature swing adsorption, pressure swing adsorption or other adsorptive gas purification method. The resulting purified air stream is divided into two flows. One flow passes through a main heat exchanger 8 from its warm end 10 to its cold end 12, and is thereby cooled to a temperature close to its dew point such that the flow can be separated by rectification at cryogenic temperatures. The thus cooled flow of air is introduced in vaporous state through an inlet 14 into a bottom region of a higher pressure rectification column 16. The higher pressure rectification column 16 forms with a lower pressure rectification column 18 and a condenser-reboiler 20, a double rectification column indicated generally by the reference numeral 22.

The other flow of purified air is sent to a first booster-compressor 24 which includes compression stages 26, 28 and 30. Downstream of the stage 26 the other flow of purified air is cooled in an aftercooler 32 so as to remove the heat of compression. This aftercooled flow of compressed air is divided again into two subsidiary streams. The first of these subsidiary streams flows to a second booster-compressor 34 in which it is yet further compressed. The resultant yet further compressed subsidiary air stream is cooled in an aftercooler 36 so as to remove heat of compression therefrom and flows through the main heat exchanger 8 from its warm end 10 to an intermediate region thereof. The yet further compressed first subsidiary stream is withdrawn from the main heat exchanger 8 at a first intermediate temperature typically in the order of 150K and is expanded with the performance of external work in an expansion turbine or expander 38. The thus expanded air flow exits the expansion turbine 38 at essentially the pressure at the bottom of the higher pressure rectification column 16 and at a temperature a little above its dew point. This air stream is mixed with the flow of air that enters the higher pressure rectification column 16 through the inlet 14. The external work performed by the turbine 38 is used to drive the second booster-compressor 34. To this end, the rotor (not shown) of the expansion turbine may be mounted on the same shaft as the rotor (not shown) of the second booster-compressor 34.

The second subsidiary air flow from the aftercooler 32 flows to the compression stage 28 of the first booster-compressor 24 and is again further compressed therein. The resulting air exits the second stage 28 and is cooled in an aftercooler 40 so as to remove its heat of compression. The flow of air from the aftercooler 40 is yet again divided into two parts. One part flows through the main heat exchanger 8 from its warm end 10 to its cold end 12, from where it flows through a throttling valve 42. This air flow leaves the throttling valve 42 at least in part in liquid state and is introduced into an intermediate mass exchange region of the higher pressure rectification column 16 through an inlet 44.

The other part of the air leaving the aftercooler 40 flows through the final stage 30 of the first booster-compressor 24 in which it is compressed to the highest pressure that obtains in operation of the apparatus shown in the accompanying drawing. The resulting stream of compressed air is cooled in an aftercooler 46 so as to remove its heat of compression. The cooled air flows from the aftercooler 46 through the main heat exchanger 8 from its warm end 10 to its cold end 12, from where it flows through another throttling valve 48. The air stream leaves the throttling valve 48 at least in part in liquid state and enters the higher pressure rectification column 16 through an inlet 50 which is typically located at the same level of the column 16 as the inlet 44.

The air that enters the higher pressure rectification column 16 is separated therein into a bottom oxygen-enriched liquid air fraction and a top vaporous nitrogen fraction. A first flow of the vaporous nitrogen fraction passes into the condenser-reboiler 20 and is condensed therein. A part of the resulting condensate is returned to the top of the higher pressure rectification column 16 as reflux. Another part of the condensate flows through a further heat exchanger 52 in which it is sub-cooled. At least a part of the resultant sub-cooled liquid nitrogen condensate passes through a throttling valve 54 into a top region of the lower pressure rectification column and provides reflux for the column 18.

A stream of the bottom oxygen-enriched liquid air fraction is withdrawn under pressure from the higher pressure rectification column 16 through an outlet 56, is sub-cooled by passage through the heat exchanger 52, is passed through a throttling valve 58, and flows into a vaporiser-condenser 60 at a pressure in excess of 2 bar. The vaporiser-condenser comprises a vessel 62 in which is located a heat exchange block 64. A sufficient volume of oxygen-enriched liquid air is maintained within the vessel 64 such that the heat exchange block 64 is immersed therein. Liquid flows through boiling passages (not shown) in the heat exchange block 64 by virtue of a thermosiphon effect. As a result, liquid is partially vaporised. The resultant vapour phase disengages from the residual liquid. By virtue of the partial vaporisation, the liquid within the vessel 62 is further enriched in oxygen while the vapour phase is depleted of oxygen relative to the liquid that enters the vessel 62. A stream of the further enriched liquid air flows out of the bottom of the vessel 62 and is further reduced in pressure by passage through a throttling valve 66. The resulting throttled further-enriched liquid flows into a condenser 68 which is operatively associated with a side rectification column 70 and which condenses argon vapour separated in the side rectification column 70. As a result of this condensation, the further-enriched liquid stream is either partially or totally vaporised. As shown in the drawing, a stream of the resulting vapour flows from the condenser 68 through an inlet 72 into a chosen intermediate location of the lower pressure rectification column 18 and a stream of residual liquid flows from the condenser 68 through an inlet 74 into the same location of the lower pressure rectification column 18.

A first stream of vapour phase from the vaporiser-condenser 60 flows from the top of the vessel 62 into a cryogenic compressor 120. It is re-compressed therein to essentially the pressure at the bottom of the higher pressure rectification column 16. The resulting re-compressed vapour is mixed with the air stream that flows from the cold end 12 of the main heat exchanger 8 to the inlet 14 to the higher pressure rectification column 16. The re-compressed vapour flow thus serves to increase the amount of nitrogen that is separated in the higher pressure rectification column with the attendant advantages as described hereinabove.

A second stream of vapour phase from the vaporiser-condenser 60 flows from the top of the vessel 62 through the main heat exchanger 8 from its cold end 12 to a chosen intermediate region thereof at which its temperature is in the order of 105K. The second vapour stream is withdrawn from the main heat exchanger at this temperature and is expanded with the performance of external work in a second expansion turbine 76. A vapour stream leaves the turbine 76 at essentially the operating pressure of the lower pressure rectification column 18 and at approximately its dew point. This vapour stream flows into the lower pressure rectification column 18 through an inlet 78 which is typically located at the same general level as the inlet 72 and 74 but which may, if desired, be located a few theoretical trays thereabove.

Because the expansion turbine 76 exhausts into the lower pressure rectification column 18 the expansion turbine 38 does not exhaust into this column but instead exhausts into the higher pressure rectification column. This factor also serves to enhance the amount of nitrogen separated in the higher pressure rectification and hence the amount of reflux produced.

The second expansion turbine 76 and the cryogenic compressor 120 share a common drive shaft 122. Preferably there is also mounted on the shaft 122 a separate device 124 which may take the form of a heat-dissipative brake or an electric generator. It can therefore be arranged for the work produced by the second expansion turbine 76 to be in excess of or less than the work required to drive the cryogenic compressor 120.

The vaporiser-condenser 60 is not the only source of oxygen-nitrogen-argon mixture for separation in the lower pressure rectification column 18. A liquid stream, typically having essentially the same composition as air, is withdrawn through an outlet 80 from an intermediate mass exchange region of the higher pressure rectification column 16 and flows through the heat exchanger 52, thereby being sub-cooled. This sub-cooled liquid air stream flows through a throttling valve 82 and is introduced into a chosen intermediate mass exchange region of the lower pressure rectification column 18 through an inlet 84 which is typically located above the level of the inlet 72 and 74. This liquid stream enhances the reflux ratio in the section of the lower pressure rectification column 18 immediately below the level of the inlet 84. The air is separated in the lower pressure rectification column 18 into a bottom liquid oxygen fraction and a top vaporous nitrogen fraction. The bottom liquid oxygen fraction is partially reboiled in the condenser-reboiler 20 by indirect heat exchange with the condensing nitrogen therein. Vapour flow upwardly through the column 18 is thereby created. A gaseous nitrogen product is formed by withdrawing a stream of the top nitrogen vapour from the lower pressure rectification column 18 through an outlet 86. This nitrogen stream flows through the heat exchanger 52 countercurrently to the streams being sub-cooled therein and is thereby warmed. The nitrogen stream is further warmed by passage through the main heat exchanger 8 from its cold end 12 to its warm end 10. A liquid oxygen stream is withdrawn from the bottom of the lower pressure rectification column 18 through an outlet 88. The stream is sub-divided. One part flows via a conduit 90 to a liquid oxygen storage facility (not shown). The remainder of the liquid oxygen stream is pressurised by a pump 92 to a chosen elevated pressure and flows through the main heat exchanger 8 from its cold end 12 to its warm end 10. A relatively high pressure gaseous oxygen product is thereby formed. If desired, as shown in the drawing, an additional high pressure oxygen product at even higher pressure may be formed by withdrawing a part of the pressurised liquid oxygen stream from upstream of the cold end 12 of the main heat exchanger and pressurising it to an even higher pressure in a further pump 94. The further pressurised liquid oxygen stream flows through the main heat exchanger 8 from its cold end 12 to its warm end 10 and is taken from the warm end 10 as a high pressure gaseous oxygen product.

In order to produce an argon product an argon-enriched oxygen stream is withdrawn from a chosen region of the lower pressure rectification column 18 where the argon concentration is in the range of about 5 to about 15% by volume and flows via conduit 96 into the bottom of the side rectification column 70. An argon product containing at least 90 mole percent of argon is separated in the side rectification column 70. The argon product preferably contains at least about 97% by volume of argon and, more preferably, contains less than about 10 volumes per million of oxygen and other impurities. In order to achieve such a high purity level, the side rectification column 70 typically contains in the order of 200 theoretical stages which, although not shown in the drawing, are preferably housed in two separate vessels in a manner well known in the art.

Typically, the argon vapour flows from the top of the side rectification column 70 into the condenser 68 and is condensed therein. A part of the resulting condensate is returned to the column 70 as reflux and the remainder taken via conduit 102 as product. If desired, this product liquid argon may be further purified by any method known in the art, for example by further rectification in order to strip nitrogen impurity therefrom. In an alternative arrangement, which is not shown in the drawing, a part of the argon vapour may be taken as product and all the condensed argon returned to the side rectification column 70 as reflux. In a yet further arrangement which is also not shown in the drawing, both vaporous and condensed argon products may be taken.

A liquid oxygen stream containing argon is returned from the bottom of the side rectification column 70 via a conduit 98 to the region of the lower pressure rectification column 18 from which the argon-enriched oxygen stream is withdrawn. In addition, a vapour stream is withdrawn from an intermediate mass exchange region of the side rectification column via conduit 99, is employed to provide the necessary heat to the heat exchange block 64 so as partially to vaporise the oxygen-enriched liquid air stream that is sent to the vaporiser-condenser, and is returned via a conduit 101 to the same region of the side rectification column 70 as that from which the vapour stream is withdrawn.

If desired, the plant shown in the drawing may also provide a liquid nitrogen product. To this end, a part of the sub-cooled liquid nitrogen stream instead of being sent to the throttling valve 54 may be passed through a further throttling valve 104 into a liquid nitrogen storage vessel 106 having a bottom outlet 108.

If desired, the plant shown in the drawing may additionally produce a relatively high pressure gaseous nitrogen product. To this end, a part of the nitrogen vapour separated in the higher pressure rectification column 16 flows via a conduit 110 to the main heat exchanger 8 and is warmed therein by passage from its cold end 12 to its warm end 10.

In a typical example of the operation of the plant shown in the drawing, the main compressor 2 has an outlet pressure of approximately 5.8 bar, the booster-compressor stage 26 an outlet pressure of 12 bar, the booster-compressor stage 28 an outlet pressure of about 32 bar and the booster-compressor stage 30 an outlet pressure of about 80 bar. In this example, the booster-compressor 34 may have an outlet pressure of about 16 bar. The higher pressure rectification column 16 is operated at a pressure of about 5.5 bar at its bottom, the lower pressure rectification column 18 and the side rectification column 70 both have a bottom pressure of approximately about 1.4 bar, and the vaporiser-condenser 60 is operated at a pressure of about 2.6 bar. Gaseous oxygen products are produced at pressures of about 13 and about 60 bar, and liquid argon and gaseous nitrogen products are also produced. The production of liquid argon product is about 4.3 mole percent of the total production of oxygen product, and the production of the pressurised nitrogen product via conduit 110 is about 71 mole percent of the total production of oxygen product. The argon recovery is approximately 96%. The vapour loading of the higher pressure rectification column was increased by about 20% over a similar system without the cold compressor 120.

I claim:

1. A method of separating air in a double rectification column comprising a higher pressure rectification column, a lower pressure rectification column, and a condenser-reboiler placing the higher pressure rectification column in heat exchange relationship with the lower pressure rectification column, said method comprising:

introducing at least one stream of air into the double rectification column;

pressure reducing a liquid stream of pressurised liquid comprising oxygen and nitrogen;

at least partially vaporizing said liquid stream;

producing a vapor stream from the at least partial vaporization of the liquid stream;

compressing said vapor stream at cryogenic temperature;

indroducing said vapor stream after the compression thereof into the double rectification column;

withdrawing an oxygen product from the lower pressure rectification column.

2. The method according to claim 1, wherein the said vapor stream is introduced into the higher pressure rectification column.

3. The method according to claim 1, wherein the liquid stream is provided at the operating pressure of the higher pressure rectification column.

4. The method according to claim 3, wherein the liquid stream is taken from the higher pressure rectification column.

5. The method according to claim 1, wherein another vapor stream, having a composition of said vapor stream, is expanded in a turbine and is introduced into the lower pressure rectification column.

6. The method according to claim 5, wherein more power is generated by the turbine than is consumed by the compression at cryogenic temperature.

7. The method according to claim 1, wherein the at least partial vaporisation of the liquid stream is performed at a pressure in excess of about 2 bar in a vaporiser-condenser separate from any condenser in which argon-rich vapour containing at least about 90 mole percent of argon is condensed.

8. The method according to claim 1, wherein no argon product is separated and the said at least partial vaporisation is effected by indirect heat exchange of the liquid stream with a nitrogen stream separated in the higher pressure rectification column.

9. The method according to claim 1, wherein:

an argon product is formed by withdrawing from an intermediate mass exchange region of the lower pressure rectification column a vaporous oxygen stream containing argon and by separating the vaporous oxygen stream in a side column and;

wherein the at least partial vapporisation is effected by indirect heat exchange of the liquid stream of pressurised liquid with at least one of the following streams:

a) a withdrawn stream withdrawn of vapour withdrawn from the same region of the lower pressure rectification column as that from which the vapourous oxygen stream is withdrawn;

b) an oxygen-enriched vapour stream withdrawn from a region of the lower pressure rectification column above the region from which the vapourous oxygen stream is withdrawn for separation in the side column, but below that at which oxygen-enriched vapour is introduced into the lower pressure rectification column for separation; and c) a side vapour stream withdrawn from the side rectification column.

10. The method according to claim 9, wherein the side vapour stream withdrawn from the side rectification column is taken from an intermediate mass exchange region thereof.

11. The method according to claim 9, wherein the at least one of the side vapour stream, the oxygen-enriched vapor stream, and the withdrawn stream of vapor is condensed through the heat exchange with the liquid stream.

12. The method according to claim 9, wherein the liquid stream is partially vaporised, and a stream of residual pressurised liquid is reduced in pressure by passage through a valve, is vaporised in indirect heat exchange with condensing argon separated in the side rectification column, and resulting vapour is introduced into a selected region of the lower pressure rectification column above that from which the vaporous oxygen stream is taken for separation in the side rectification column.

13. An apparatus for separating air, comprising:

a double rectification column comprising a higher pressure rectification column, a lower pressure rectification column, and a condenser-reboiler placing the higher pressure rectification column in indirect heat exchange relationship with the lower pressure rectification column;

at least one inlet to the double rectification column for at least one stream of air to be separated;

a vaporiser-condenser having vaporising passages in communication via pressure reduction means with a source of pressurised liquid comprising oxygen and nitrogen to be partially or totally vaporised;

a cryogenic compressor having a compressor inlet communicating with an outlet for vaporised pressured liquid from the vaporiser-condenser and a compressor outlet communicating with the double rectification column; and a product outlet for oxygen product from the lower pressure rectification column.

14. The apparatus according to claim 13, additionally including an expansion turbine, the expansion turbine having a turbine inlet communicating with a vaporiser condenser inlet for vaporised pressurised liquid from the vaporiser-condenser and a turbine outlet communicating with the lower pressure rectification column.

15. The apparatus according to claim 14, in which the cryogenic compressor and the expansion turbine are mounted on the same shaft.

16. The apparatus according to claim 14, in which the expansion turbine is coupled to a heat dissipative device or to a motor or to a generator of electrical power.

* * * * *